US006106135A

United States Patent [19]

Zingale et al.

[11] Patent Number: 6,106,135

[45] Date of Patent: Aug. 22, 2000

[54] DECORATIVE ILLUMINATED BALLOONS

[76] Inventors: Robert Zingale, 50 Salem Ridge Dr.; Eric Koenig, 8 E. Carver St., both of Huntington, N.Y. 11743

[21] Appl. No.: 09/021,930

[22] Filed: Feb. 11, 1998

[51] Int. Cl.[7] ..... F21L 4/00; F21K 2/06

[52] U.S. Cl. ..... 362/186; 362/34; 362/189; 362/253; 362/363; 362/806; 446/219; 446/220

[58] Field of Search ..... 446/219, 220, 446/225, 226, 484, 485; 362/34, 84, 186, 189, 253, 363, 384, 401, 806, 808, 809

[56] References Cited

U.S. PATENT DOCUMENTS

| | | | |
|---|---|---|---|
| 3,592,157 | 7/1971 | Schwartz | 116/124 B |
| 3,672,083 | 6/1972 | Moran | 40/126 B |
| 4,015,111 | 3/1977 | Spector | 446/220 |
| 4,292,999 | 10/1981 | Szollman | 137/560 |
| 4,438,588 | 3/1984 | Martin | 446/484 |
| 4,542,445 | 9/1985 | Marletta | 362/96 |
| 4,704,934 | 11/1987 | Nosrati | 446/220 |
| 4,787,575 | 11/1988 | Stewart | 244/33 |
| 4,794,498 | 12/1988 | Neumeier | 362/186 |
| 4,903,958 | 2/1990 | Dicarlo | 272/27 N |
| 4,932,915 | 6/1990 | Boris et al. | 446/220 |
| 5,075,830 | 12/1991 | Perez | 362/352 |
| 5,083,250 | 1/1992 | Malcolm | 362/253 |
| 5,117,344 | 5/1992 | Perez | 362/352 |
| 5,119,281 | 6/1992 | Akman | 362/253 |
| 5,215,492 | 6/1993 | Kubiatowicz | 446/219 |
| 5,295,891 | 3/1994 | Schalk | 446/222 |
| 5,444,607 | 8/1995 | Dreyfuss | 362/352 |
| 5,846,118 | 12/1998 | Wu | 446/220 |
| 5,924,942 | 7/1999 | Gentile | 446/485 |

*Primary Examiner*—Alan Cariaso
*Attorney, Agent, or Firm*—Alfred M. Walker

[57] ABSTRACT

An inflatable translucent balloon body has a predetermined net lifting force upon inflation with a lighter than air gas. A light source is attached to the balloon upon inflation by a light transmitting tether. To keep the buoyant balloon afloat while attached to the light transmitting tether, the light transmitting tether has a net weight of less than the net lifting force of the balloon in an inflated state with lighter than air gas therein.

10 Claims, 7 Drawing Sheets

DECORATIVE ILLUMINATED BALLOONS

FIELD OF THE INVENTION

The present invention relates to illuminated decorative balloons and movable illumination members inserted therein.

BACKGROUND OF THE INVENTION

It is desirable to use illuminated balloons as decorative or as elements at festive occasions, such as birthday parties, accessories in the general decor of night clubs or similar establishments.

The prior art does have some notable examples of methods and apparatus to illuminate balloons. Stewart (U.S. Pat. No. 4,787,575) describes a sturdy signal balloon device of special construction with either an electrically conductive tether or a fiber optic tether. However, Stewart '575 does not describe how to illuminate a buoyant lightweight party balloon with a minimal net lifting weight. Also, Stewart '575 does not describe how to vary the illumination emitted from the balloon, to provide a sparkling festive party atmosphere.

Malcolm (U.S. Pat. No. 5,083,250) shows a cone shaped floatable light socket and lamp accessory using a conductive tether within a balloon However, Malcolm '250 requires leaving the socket within the orifice neck of the balloon, and therefore the socket is stationary in place.

Akman (U.S. Pat. No. 5,119,281) describes a balloon lighting device and method involving a rigid plug through which the balloon is inflated and which also serves as a conduit for the insertion of an illuminating bulb. As in Malcolm '250, the plug of Akman '281 is stationary within the neck of the balloon.

Schalk (U.S. Pat. No. 5,295,891) describes a bowl shaped device that both illuminates the balloon from the outside as well as clamping the end to prevent escape of gas. However, in Schalk '891, the balloon is not floating buoyant and is held within the buoy-shaped device. Kubiatowicz (U.S. Pat. No. 5,215,492) relates to cool illumination of balloons by internally suspended electrical or chemoluminescent means. However, in Kubiatowicz '492, the suspended light source gives off light uniformly, and does not vary by the motion of the balloon.

Perez (U.S. Pat. No. 5,117,344) describes a light source externally attached to a balloon powered by a conductive tether and illuminating a translucent pattern through the balloon.

Perez (U.S. Pat. No. 5,075,830) also shows a specially constructed balloon which is externally illuminated by an attached light source. However, in Perez '344, and Perez '830 the illuminating device encumbers the outside of the balloon.

Marietta (U.S. Pat. No. 4,542,445) describes a torch-like apparatus with a balloon attached at the end of a rigid tube; the balloon is illuminated by a light source at the end distal to the balloon. However, in Marletta '445 the balloon is restricted in movement due to its attachment to the rigid tube.

Dreyfuss (U.S. Pat. No. 5,444,607) illustrates a funnel shaped balloon coupling atop a battery box which also houses an illuminating bulb. However, this is used as a table-top display device, not for a buoyant balloon.

Schwartz (U.S. Pat. No. 3,592,157) describes a large illuminated balloon using an internal light source to be used as a signal beacon or display device. It has a reflective lower internal surface, and the light, which may be flashing, is powered via a conductive tether.

The embodiments of this invention differ from the prior art in several respects as will become evident upon examination.

OBJECTS OF THE INVENTION

It is an object of the present invention to use a single fiber optic tether to illuminate a buoyant balloon or to project patterns on its surface.

It is a further object of the present invention to relate the color and intensity of the balloon illumination to music or other sound sources.

It is another object of the present invention to illuminate a buoyant balloon with a variety of colors in a random fashion as a function of balloon motion.

It is yet a further object of the present invention to illuminate patterns on the surface of a buoyant balloon.

It is yet another object of the present invention to provide a swaying illuminated balloon tree.

It is yet another embodiment to improve over the disadvantages of the prior art.

SUMMARY OF THE INVENTION

In keeping with these objects and others which may become apparent, a preferred embodiment of the present invention is an illuminated balloon assembly, wherein a light source is attached to a buoyant, floating balloon, upon inflation, by a light transmitting tether.

Typically, an inflatable translucent balloon body has a predetermined net lifting force upon inflation with a lighter than air gas, such as helium. Therefore to keep the buoyant balloon afloat while attached to the light transmitting tether, the light transmitting tether must have a net weight of less than the net lifting force of the balloon in an inflated state with lighter than air gas therein.

In a non-preferred embodiment, balloons with gases which are equal to or greater than air, such as exhaled breath or argon, will not be buoyant, but they can be illuminated. However, in this non-preferred embodiment, the inflated balloon must be supported either by an upright wood, such as a wooden or plastic dowel, or must be suspended from an upper surface, such as a ceiling, by a supporting tether.

In a preferred embodiment, light transmitting tether includes one or more light transmitting fibers, such as fiber optic fibers of glass, silicon or plastic, projecting light outwards through the translucent balloon in its inflated state.

The balloon can be either enlargeable to an inflated state by being elastic, such as made of rubber or latex, or the balloon may be inflatable but inelastic, such as made of a flexible but inelastic plastic as MYLAR®, as long as it is translucent.

To vary the light patterns emanating from the light emitting ends of the light transmitting fibers, the ends may be shaved or shaped in predetermined geometric shapes, such as a flat facet, a truncated facet, a cube or a rounded dome.

The light source may be a box having a light source powered by an electrical power source, wherein the light source is an incandescent lamp, a light emitting diode, a laser light or a flashing xenon lamp.

To power the light source, the electrical power source may be either an internal DC power battery or an AC power connection to an AC utility power.

To inflate the balloon and insert the light transmitting fibers therein, an optional inflator includes a nozzle connected to a helium gas tank, wherein the nozzle has an orifice end and the balloon is stretchable and sealed over the nozzle. Preferably the inflator has a soft tubing segment, into which the light transmitter fibers are insertable for insertion thereafter into the balloon.

Optionally, the balloon may be attached to an illumination modulator including a microphone communicating with an amplifier. The microphone transmits ambient sounds, such as external music or crowd noise, to the amplifier, which amplifies the ambient sounds to one or more filters, such as a low pass audio filter, a mid-range band pass filter or a high pass audio filter. The filters pass frequencies of these amplified ambient sounds to one or more power amplifiers, which provide electrical power to light one or more colored and variably flashable light bulbs. The flashing of each colored light bulb responds to the amplified frequencies of the ambient sounds.

To further enhance the flashing of the lights within the balloons in time to the ambient sounds, such as music, an auxiliary audio input may be selectively wired by a switch to the power amplifier to add artificial sound to the amplified ambient sound.

In an optional embodiment, the light source and the light transmitting tether are suspended together from an interior wall of the balloon. The light source may be a suspendable light module having one or more light emitting diodes and a battery power source lighting the light emitting diodes.

In yet another embodiment, the light module may include a motion sensor, which responds to randomly movements of said light module within the balloon.

In yet still another embodiment, the light source may be an electroluminescent element, which is bonded to a surface inside the balloon.

Another version includes an illuminated tree of balloons with a plurality of inflatable translucent balloons each having an array of light transmitting fibers insertable through a coupling. The light transmitting fibers are assembled in a semi-rigid branch array, and the branches each support a balloon. Swaying of each translucent balloon moves each light transmitting end of each light transmitting fiber, thereby cyclically changing light patterns emanating therefrom. The balloon tree may also be movable by a motor driving an oscillator for oscillating the balloons of the balloon tree.

In yet another embodiment a freely movable geometrically shaped member, such as an egg shaped insert member, is illuminated with a chemoluminescent or battery powered light source therein. The insert member may be a three dimensional body having a curved surface on part or all of its exterior surface, wherein the insert rolls freely about its exterior convex surface within a corresponding concave interior of the balloon. The insert member is insertable within a balloon. It responds to kinetic movement of the balloon, and displays varied light patterns as it moves generally within the concave bottom portion of the inflated balloon. Furthermore, the geometrically shaped insert member is preferably round, so that it can move within the balloon as it sways. However, it can be faceted along its exterior surface, to produce more light through reflection.

BRIEF DESCRIPTION OF THE DRAWINGS

The present invention can best be understood in connection with the accompanying drawings, in which.

DETAILED DESCRIPTION OF THE DRAWINGS

Before discussing the various embodiments it is noted that a conventional freshly inflated helium filled party balloon measuring about 12 inches in height and 10 inches in diameter has a net lifting force of approximately ½ ounce (14 grams). After a period of time, as the helium permeates through the latex or other suitable skin, this is gradually reduced to zero. All of the embodiments of this invention except one involve the use of ordinary latex buoyant helium filled balloons. Translucent inelastic but inflatable balloons, of plastics such as MYLAR®, may also be illuminated. It is assumed that the balloons will remain buoyant for several hours providing the decorative function for which they are designed, such as at a party or catered affair.

Figure 1A:
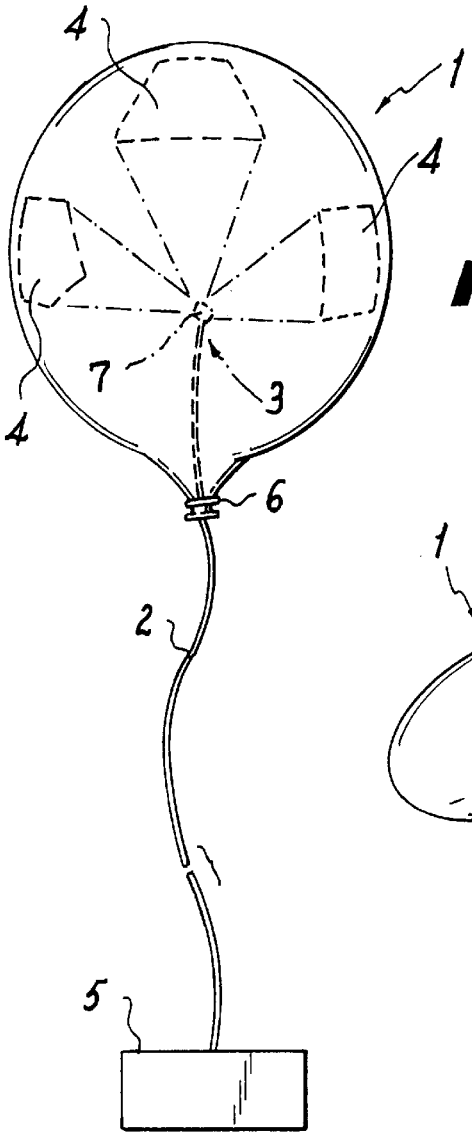
FIG. 1A is a side view of a first embodiment for a buoyant balloon illuminated by a fiber optic tether.

A first embodiment as in FIG. 1A involves the use of fiber optic tether 2 which originates in light box 5 and terminates at distal free end region 3 inside balloon 1, with a faceted or lens capped end 7. Tie 6 closes the balloon end in a gas tight fashion around fiber optic tether 2. Faceted or a lens cap end 7 includes one or more surface projections or facets which project patterns 4 of light on the interior surface of balloon 1, which light patterns 4 can be easily seen from the outside through the translucent membrane of balloon 1.

Figure 1B:
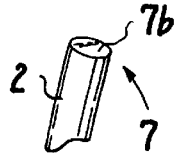
FIGS. 1B, 1C, 1D and 1E and close up isometric views of various modified ends of fiber optic tethers.
Figure 1C:
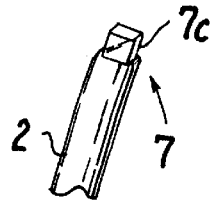

As shown in FIGS. 1B, 1C, 1D, 1E, ends 7 of distal free end region 3 of fiber optic tether 2 may be cut and modified with various geometric shapes for the purpose of establishing variable light transmission patterns. In FIG. 1B, a flat facet 7*b*, is provided by transversely cutting end 7. In FIG.

Figure 1D:
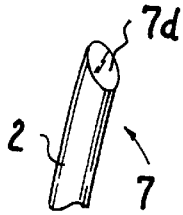
Figure 1E:
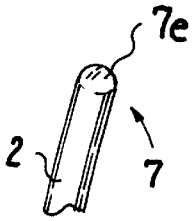

1C, end 7 is shaped to form a cube 7*c*. In FIG. 1D, end 7 is faceted and shaped obliquely to form truncated facet 7*d*. Moreover, in FIG. 1E, end 7 is shaped with dome 7*e*.

The light source within light box 5 may be an incandescent lamp, a large light emitting diode, a laser, or a flashing xenon lamp. These light sources may be powered by an internal DC powered battery or an AC connection to utility provided power.

To determine the amount of fiber optic fiber able to suspend by buoyant helium filled balloon 1, it is noted that a standard party balloon, such as balloon 1, can easily lift 8 to 10 linear feet (2.4 to 3.0 meters) of 0.04011 (1.0 mm.) diameter plastic optical fiber weighing 14 grams (1 ounce) or less, when freshly filled and for several hours. Free end 3 of fiber optic tether 2 within balloon 1 will sway as balloon 1 moves, thereby moving the projected pattern 4 in an interesting manner.

As a result, assuming that the exterior length of the tether outside of balloon 1 is about four linear feet, then inside the balloon can be up to four to six more linear feet of fiber optic fiber. Therefore, a swaying single fiber of about six to eight inches in length may be provided within the balloon or a floral display of a plurality of fibers radiating upward and outward from a gathered array of fibers may be provided therein, as long as the total net weight is less than that of the net lifting force of the balloon, namely 14 grams (1.0 ounce). Therefore, for multiple fiber arrays, the thickness of each fiber optic fiber can be reduced from 0.04011 inch (1.0 mm) to about 0.006 inch (0.15 mm).

Figure 2:
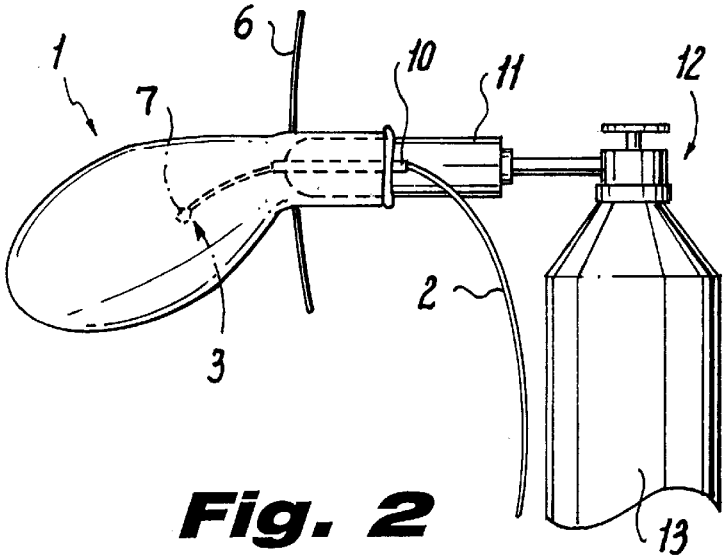
FIG. 2 is a side view illustrating an inflation method for the balloon as in FIG. 1A.

FIG. 2 is a detail showing the gas filling method of balloon 1, using a standard helium tank 13 with a standard valve/regulator 12 and balloon nozzle 11. The balloon free end of fiber optic tether 2 is threaded through a short length of tubing segment 10, such as soft silicone or latex, which tubing segment 10 easily forms a seal if finger pressure is applied against nozzle 11 at the junction of tubing 10 and the open end of balloon 1. Tubing segment 10 also facilitates a seal as tie 6 is wrapped around fiber optic tether 2 and tied to the open close neck of balloon 1.

Figure 3:
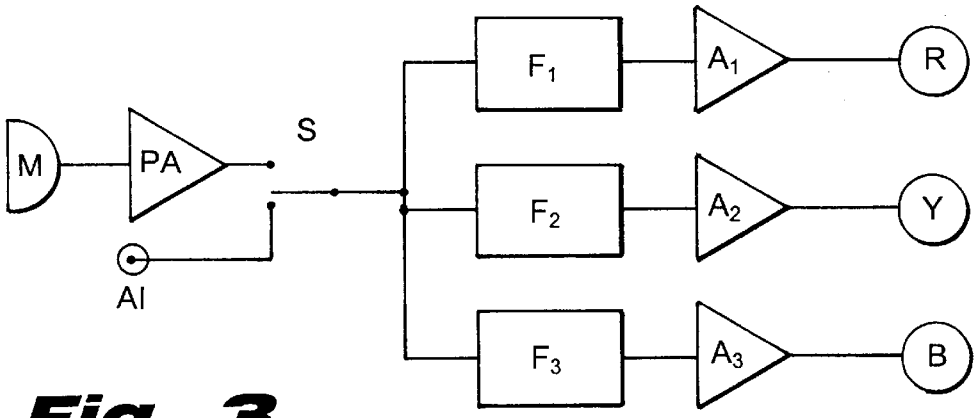
FIG. 3 is a block diagram of an alternative second embodiment for a sound modulated illumination source for the embodiment as in FIG. 1.

FIG. 3 shows a block diagram of a light source for the first embodiment shown in FIG. 1 which modulates both the color as well as the intensity of balloon illumination of balloon 1, as a function of ambient sounds, or as a function of a wired music or sound source.

To maximize illumination therefrom, balloon 1 should be preferably white. Microphone H and a preamplifier PA may be selected via switch S as the driving sound source. Alternatively, wired audio input A1 may be selected. In an environment of loud music such as in a disco or catering hall, microphone M may mainly pick up music and serve well without the necessity of hard wiring a sound source. In a more quiet environment, ambient sounds may override softer music. In this case use of audio input A1 is recommended.

Filter F1 is a low pass audio filter with a cutoff frequency of about 200 Hz; it mainly transmits bass or drum beats to power amplifier A1, which lights red lamp bulb R according to the loudness of this range of sounds.

Filter F2 is a mid-range bandpass filter which passes frequencies between 250 to 1500 Hz to amplifier A2, which lights yellow bulb Y according to the intensity of this range.

High pass audio filter F3 passes frequencies above 1500 Hz to amplifier A3 which lights blue bulb B according to the intensity of the higher frequencies.

All three lamp bulbs R, Y and B have optics to couple their output efficiently to free end 3 of fiber optic tether 2. For example, a loud crescendo of sound in all frequencies will light balloon 1 with a flash of bright white light as red lamp bulb R, yellow lamp bulb Y, and blue lamp bulb B glow brightly together to mix to a white light. A lone bass beat shows up as a flashing red balloon in rhythm.

Figure 4:
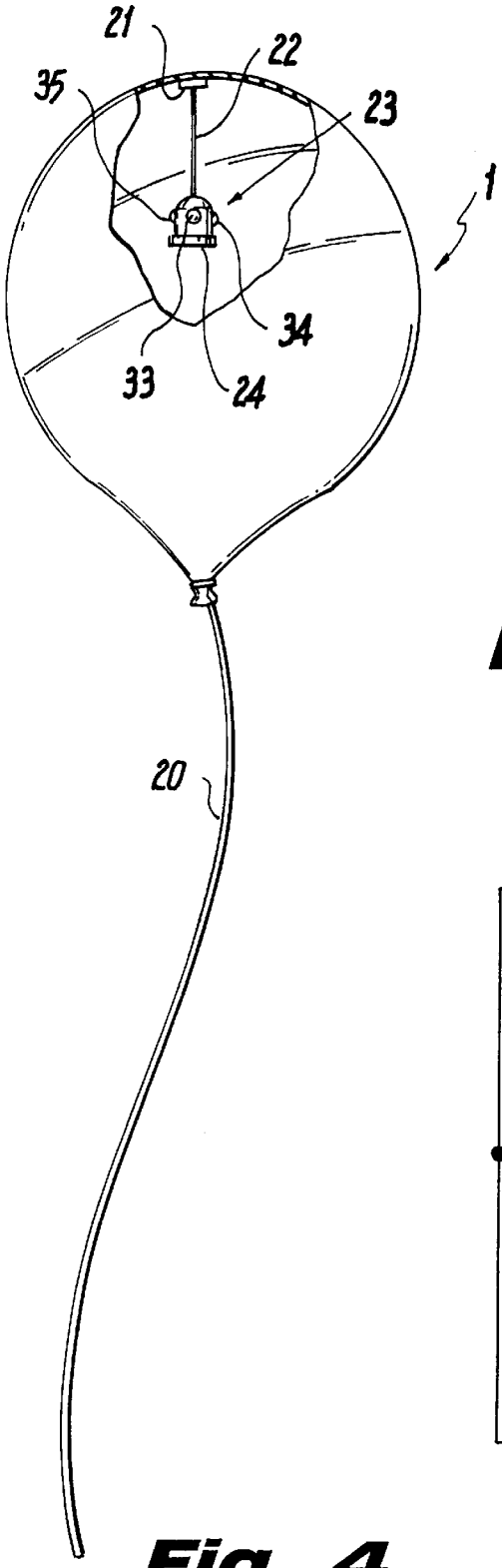
FIG. 4 is a side view of a third embodiment for a motion sensitive illuminated balloon.

A third embodiment shown in FIG. 4 uses small internal light source module 23 suspended via springy tether 22 from the interior wall of balloon 1. Attachment of springy tether 22 is by adhesive patch 21, while the uninflated balloon is held open. While it is possible to implement this version using a small party balloon such as balloon 1, it is more prudent to use a slightly larger balloon with more lifting force. The internal volume of balloon 1 and hence the lifting force of balloon 1 varies as the measured diameter of balloon 1 is mathematically cubed; thus a small increase in balloon size of balloon 1 yields a large increase in lift.

Figure 5:
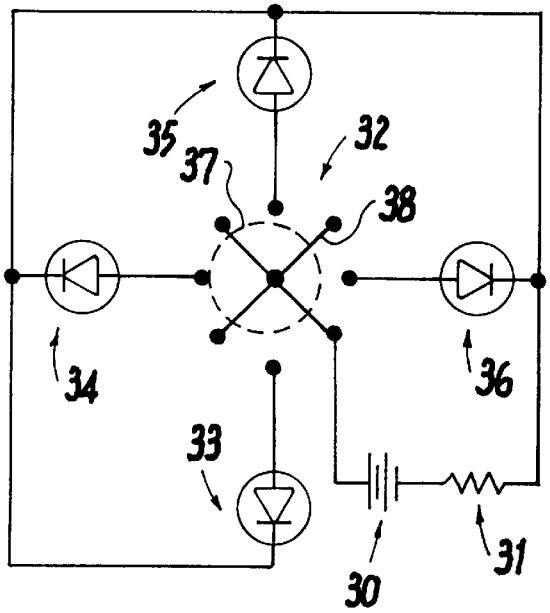
FIG. 5 is a wiring diagram of the motion sensitive balloon insert for the balloon as in FIG. A.

As shown in FIG. 5, both light source module 23, light emitting diodes (LED's) 33, 34, 35 and 36, as well as the battery power source 30, such as a lithium coin cell or cells, are carried aloft.

Very lightweight tether 20 is used simply to hold and locate balloon 1. In this case, after light source module 23 is attached to balloon 1 and inserted therein, the balloon filling and tying phase of balloon 1 is absolutely normal.

For maximum illumination emitted from within balloon 1 LED's 33, 34, 35 and 36 should be of different colors and balloon 1 is preferably white.

To cause the on and off flashing sequence of LED's 33, 34, 35 and 36, a motion sensor, such as a well known tilt sensor switch 24, known as the "ball in cage" variety, is shown in FIG. 4. FIG. 5 shows the wiring therefor, with dashed lines showing a possible position of ball 37 of sensor switch 24 which, as shown, lights LED 34, which may be, for example colored red.

As balloon 1 moves slightly due to air currents, ball 37 may roll over to next light LED 36 which may be, for example colored green, and so forth.

As shown, this embodiment with sensor switch 24 causes balloon 1 to flash in four different colors randomly.

It is further noted that battery 30 is shown in FIG. 5 as two cells with limiting resistor 31. Actually, a lithium cell, such as a single PANASONIC® BR2020 lithium cell, can be used without resistor 31. Such a lithium cell weighs a mere 0.06 ounce (1.5 grams) and can keep LED's 33, 34, 35 and 36 flickering for over 4 hours, during the life of a party or catered affair.

Figure 6A:
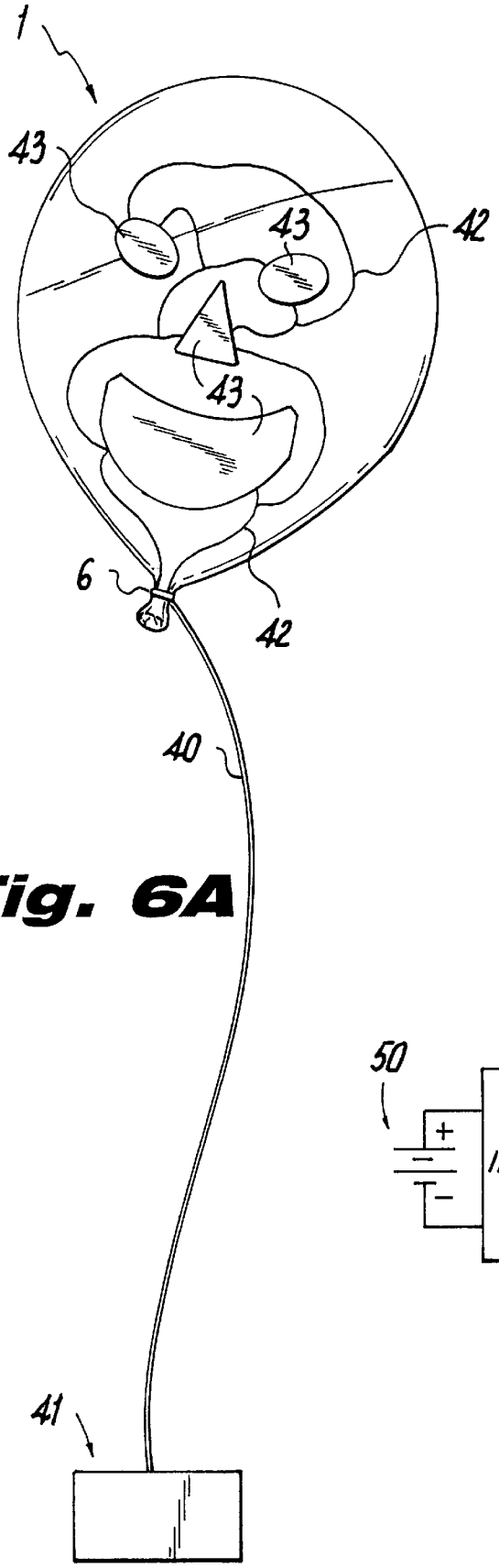
FIG. 6A is a front view of a further embodiment for an illuminated surface pattern balloon.

As shown in FIG. 6A, a fourth embodiment uses very lightweight electroluminescent elements 43 bonded to the exterior surface of an already inflated balloon 1 to create illuminated patterns such as animal or character faces, or abstract shapes. FIG. 6A shows balloon 1 with flexible electroluminescent face elements 43 constructed of shaped plastic electroluminescent elements wired together in parallel using almost invisible very small gage wire 42. Power is supplied to electroluminescent elements 43 via conductive tether 40 from base unit 41. Since electroluminescent elements 43 use extremely small current at high voltage AC, or DC power from a DC battery power pack, very minute conductors having relatively high resistance can be used. Although any colored balloon can be used, preferably balloon 1 is dark, so that in a dark room the electroluminescent elements 43 will primarily be visually ascertainable. While FIG. 6A shows electroluminescent elements 43 with specific shapes, it is noted that electroluminescent elements 43 may also be fiber optic fibers (not shown) or other luminescent material members (not shown).

Figure 6B:
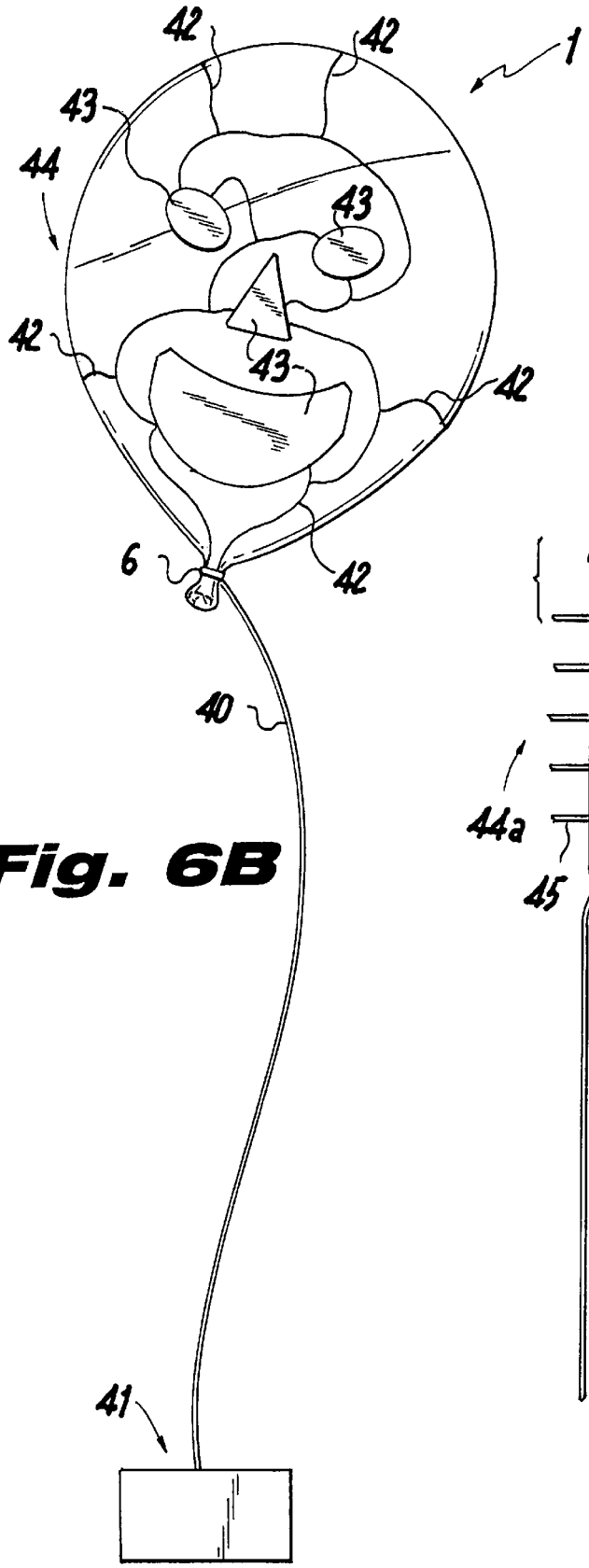
FIG. 6B is a front view of a further embodiment for an illuminated surface pattern balloon within a net.

FIG. 6B shows that array 44 of wires 42 and conductive elements 43 may be arrayed in an overhead net configuration, holding balloon 1 therein. In that case, the net array can be installed over balloon 1, such as similar to installing a pillowcase over a pillow.

Figure 6C:
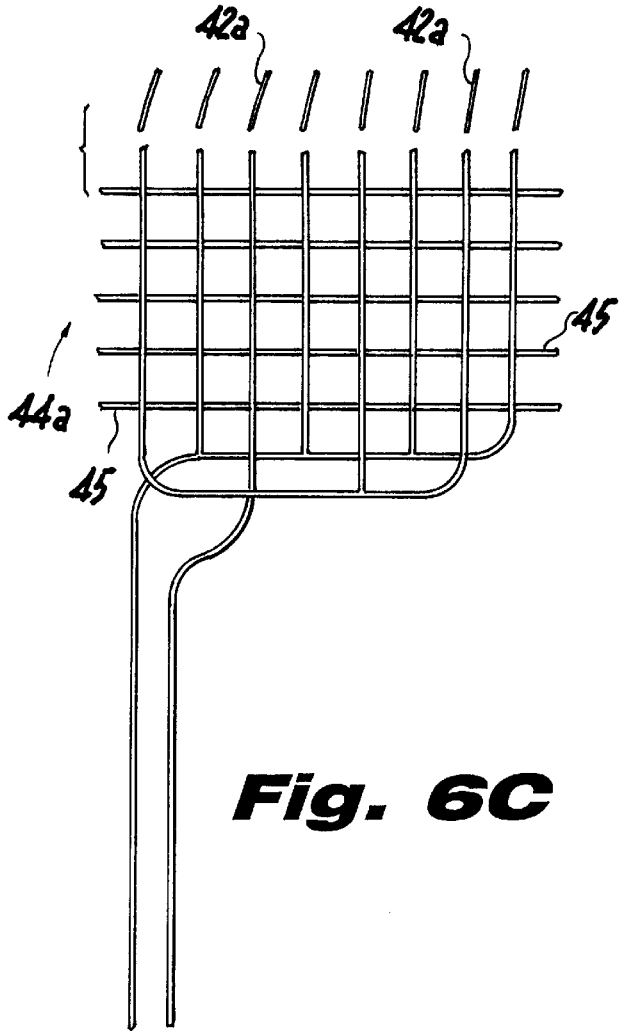
FIG. 6C is a rear view of yet another embodiment for an illuminated surface pattern balloon with a net.

FIG. 6C shows that a very lightweight wiring net 44*a* can be fabricated of parallel conductive wires 42*a* in one direction attached by non-conducting fibers 45 in an orthogonal direction. Fibers 45 can also extend omni-directional. Alternate conductor wires 42*a* are wired together and then wired to each of conductive elements, such as conductive elements 43, shown in FIGS. 6A and 6B, in the tethered arrangement shown therein in FIG. 6C.

Figure 7:
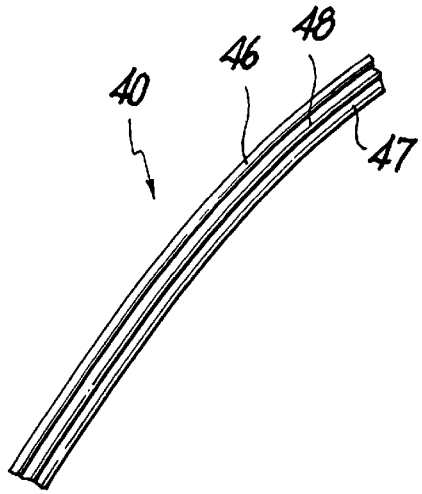
FIG. 7 is a detail of a conductive tether for the balloon as in FIG. 6.

As shown in FIG. 7, tether 40 is therefore made of a very thin narrow substrate 46, such as a ribbon of polyimide with two minute traces of conductors 47 and 48.

The polyimide of substrate 46 has a good strength to weight ratio and technology exists to form very narrow conductive strips, since it is the material of choice for flexible printed circuits.

Figure 8:
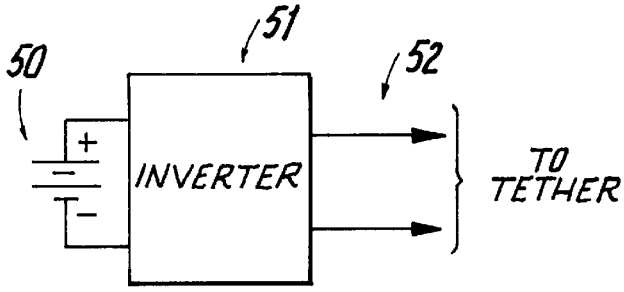
FIG. 8 is a block diagram of a power source for the surface pattern balloon as in FIG. 6.

FIG. 8 shows an electrical block diagram of the apparatus in base unit 41, including battery 50 powering inverter 51, which supplies high voltage at high frequency at terminals 52, which are attached to tether 40.

Figure 9:
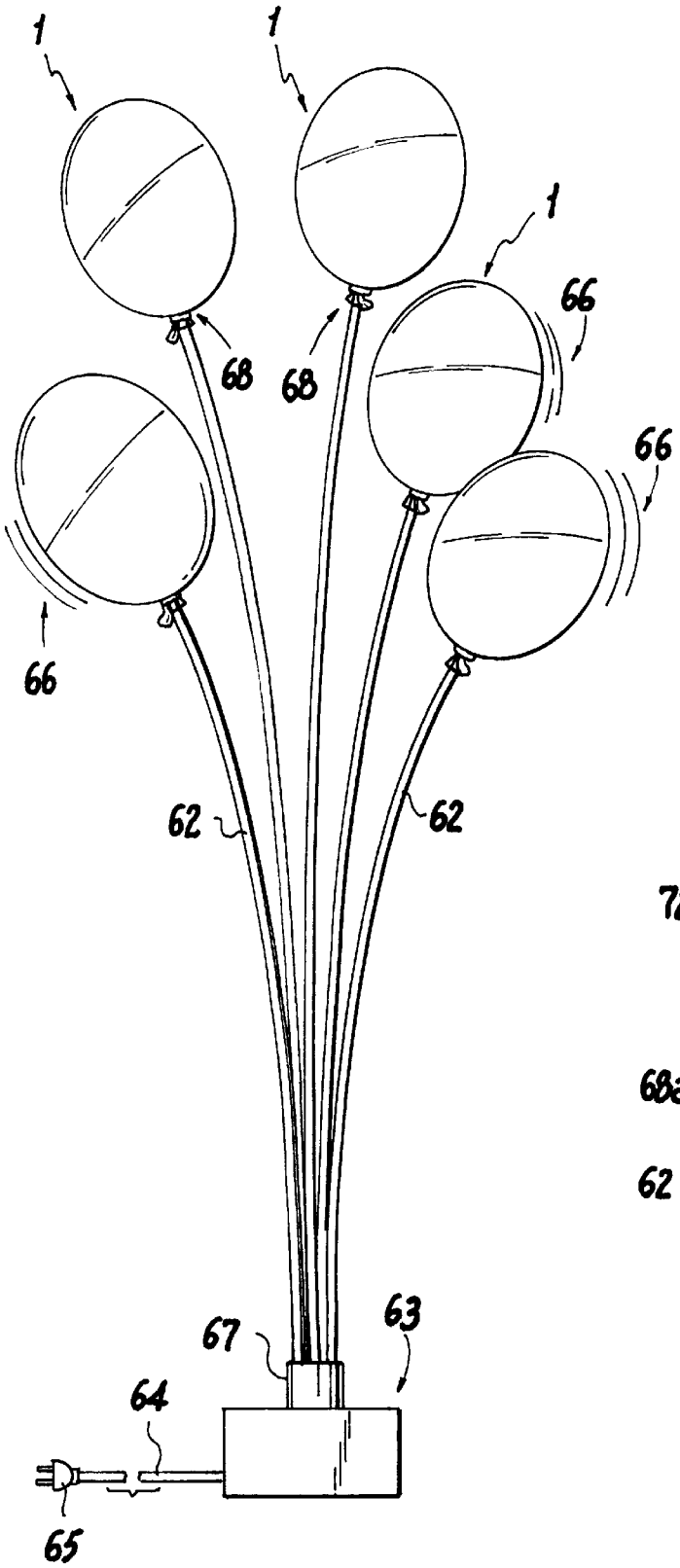
FIG. 9 is a side view of a fifth embodiment for a swaying illuminated balloon tree.

A fifth embodiment shown in FIG. 9 includes a swaying illuminated balloon tree 60 using fiber optics. In this case, a plurality of balloons preferably colored white, are simply inflated with air, since balloons 1 are supported by semi rigid branches 62 of arrays of fiber optic fibers, of balloon tree 60, balloons 1 need not be buoyant. Although any number of balloons 1 are used five balloons 1 are illustrated in FIG. 9. Both trunk 61 of balloon tree 66, as well as its branches 62, are flexible but rigid adhesively bonded groupings of optical fibers of either plastic or glass. Base collar 67 attaches balloon tree 66 to base light source 63, which light source 63 is powered via line cord 64 and conventional wall plug 65. The assembly of balloon tree 60 sways rhythmically in one plane as shown by swaying arcs 66.

Figure 10:
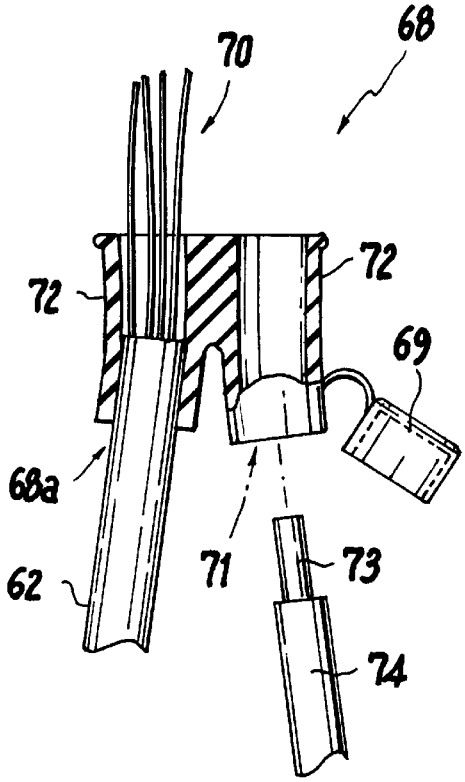
FIG. 10 is a side cross section of a balloon attachment collar for the balloons as in FIG. 9.

As shown in FIG. 10, as balloon tree 60 sways, the color of the illumination of balloons 1 cyclically changes and the light pattern thrown on the interior surface by the many fine lighted fiber ends 70 of fibers of branch 62 of fibers within balloon 1 also sways. To facilitate filling the balloons and sealing, the semi-rigid elastomeric molding coupling 68 is used.

FIG. 10 also shows coupling 68 in cross section, revealing its dual lumen construction with integrally molded and attached sealing plug 69. Orifice 68*a* of coupling 68 is used to terminate and seal branch 62 of fiber optic fibers and to admit loose fiber ends 70 thereof within the interior of each balloon 1. The neck of each balloon 1 is stretched over collar 72 of coupling 68 and tied in place. Air is admitted through orifice 71 by nozzle 73, which nozzle 73 is attached to air hose 74.

Figure 11:
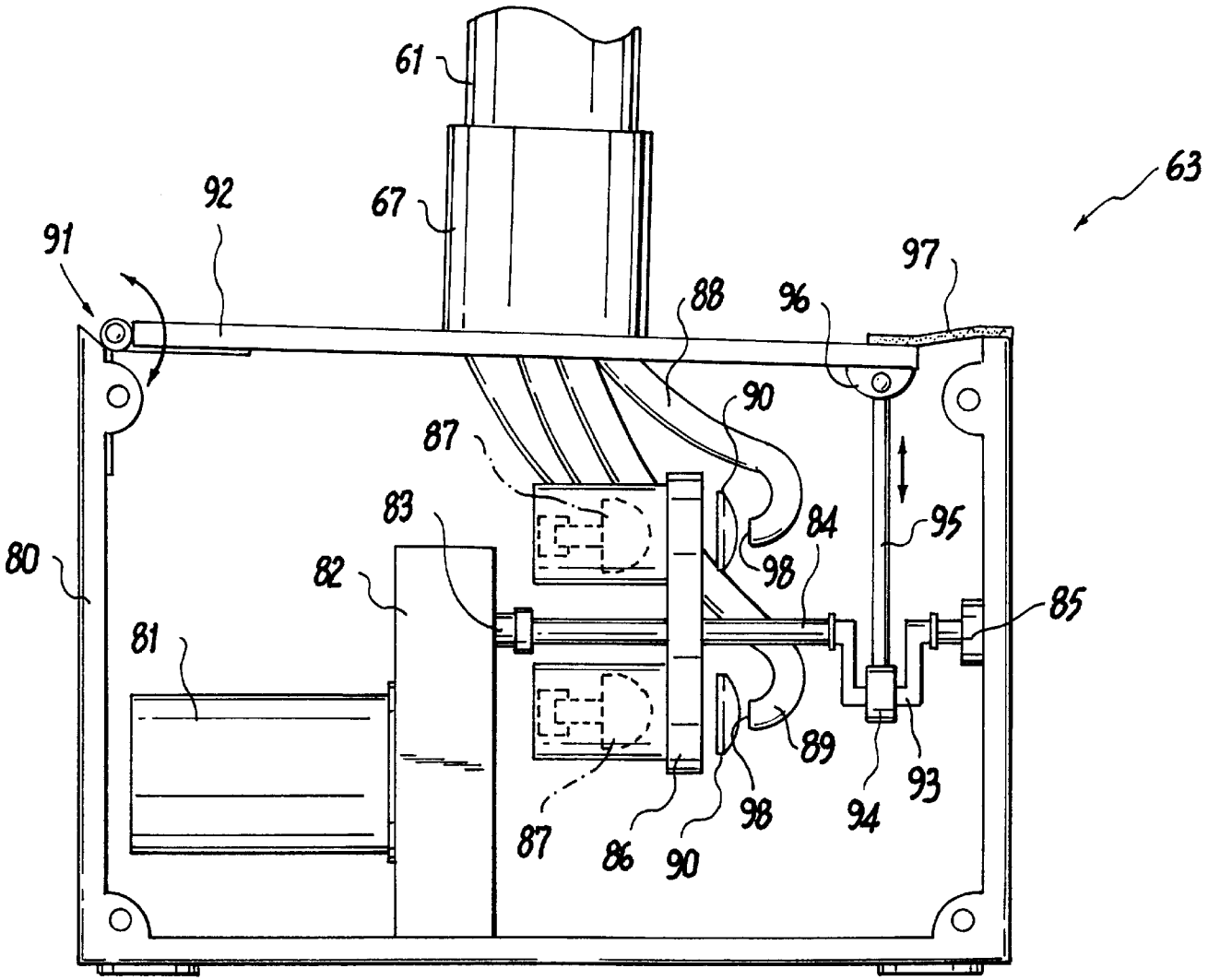
FIG. 11 is a side view of a mechanical arrangement of apparatus in the base of the swaying illuminated balloon tree as in FIG. 9.

FIG. 11 shows a side view of the mechanisms and apparatus in base unit 63 of balloon tree 60, which is shown with the side panel removed. Rigid housing 80 encloses the apparatus of base unit 63. An AC motor 81 drives a gear reduction box 82, whose output shaft 83 is coupled to shaft 84. A transparent multi-segment color wheel 86 is attached to shaft 84 which also forms crank 93 and terminates in bearing 85 which is attached to a wall of housing 80. Balloon tree 60 sways by virtue of cover 92, which is hinged at hinge 91 and caused to oscillate through a small angle produced by movement of a push rod 95, which rides on crank 93 on bearing 94 and terminates at bracket 96 attached to cover 92. Multiple lamps 87, one for each branch 62, are strategically placed behind color wheel 86, which is rotated by shaft 94. Lenses 90 focus the filtered, colored light on branch bundle ends 98 of branches 62, which are rigidly held in registration with the focus of lenses 90 (the means for which are not shown for clarity). Branch bundles such as 88 and 89 are not rigidly adhesively bonded except at the very end, so as not to resist or impede easy rocking motion of cover 92 of housing 80. An opaque strip of flexible material 97 seals cover 92 to prevent light leakage. Not shown is a blower to provide forced ventilation to cool the interior of base unit 63.

Figure 12:
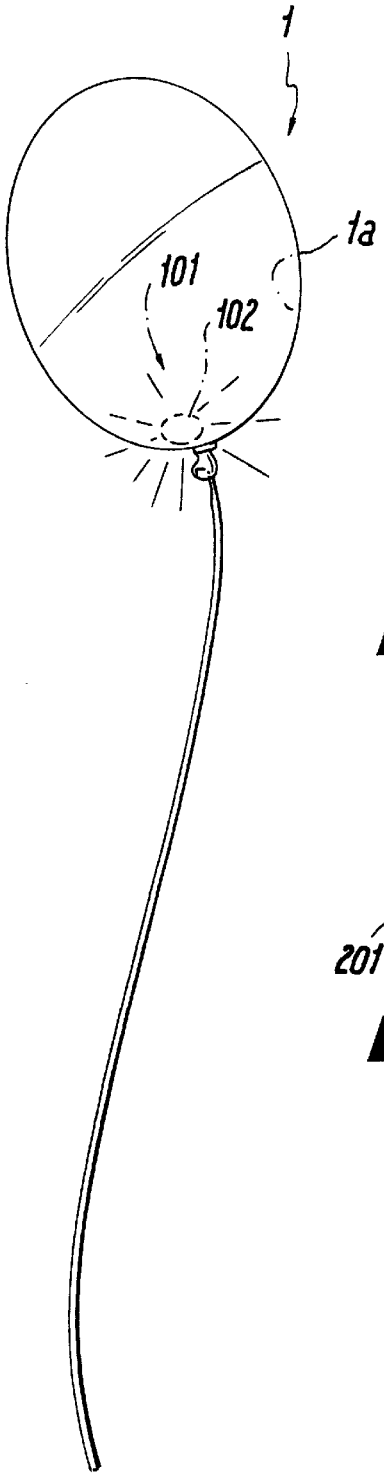
FIG. 12 is an isometric view of a sixth embodiment of a balloon illuminated by a freely movable insert.
Figure 13:
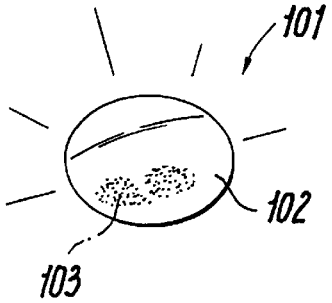
FIG. 13 is a side view of a chemiluminescent insert.
Figure 13A:
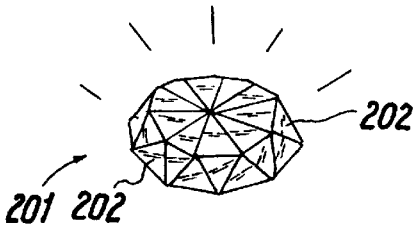
FIG. 13A is a side view of a faceted chemiluminescent insert.
Figure 14:
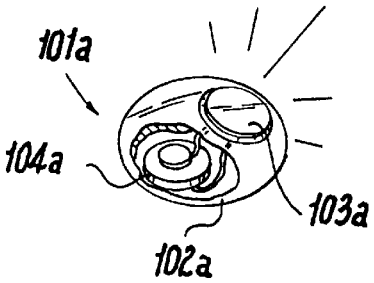
FIG. 14 is a side view of a battery powered insert.

FIGS. 12, 13, and 14 show a further embodiment for an illuminated balloon 1 having a freely movable insert 101 therein. While insert 101 can be any geometrically shaped body, preferably insert 101 is a three dimensional body having a curved surface on at least a portion thereabout, or may have a closed curved surface completely thereabout, such as a hollow plastic sphere, or preferably, an egg shape body, so that its curved exterior 102 can rock and sway within balloon 1 when balloon 1 sways while floating buoyant. Optionally, as shown in FIGS. 13A, insert 201 may have one or more facets 202 on its exterior surface.

Insert 101 rolls freely about its convex exterior surface 102 within a corresponding concave interior 1*a* of balloon 1, and generally rests within the bottom portion of balloon 1 above its gas intake orifice. Insert 101 is dynamically interactive with the kinetic action of swaying balloon 1. By its movement within balloon 1, insert 101 can diffuse light with uniformity or non-uniformity. FIG. 13 shows insert 101 as a translucent sac filled with chemoluminescent material 103, which gives off light temporarily during a predetermined second of time, such as for example, 3–4 hours.

Alternatively, as shown in FIG. 14, insert 101*a* may be a translucent sac with a exterior surface 102*a*. Insert 111*a* includes miniature battery 104*a* powering light source 103*a*, such as an LED light source, within insert 101*a*.

Because a freshly filled helium balloon has a net lifting weight of 14 grams (1 ounce), insert 101 or 101*a* must be 14 grams (1 ounce) or less in weight, to permit balloon 1 to remain buoyant for a predetermined period of time, such as a four (4) hour duration of a party affair.

Figure 15:
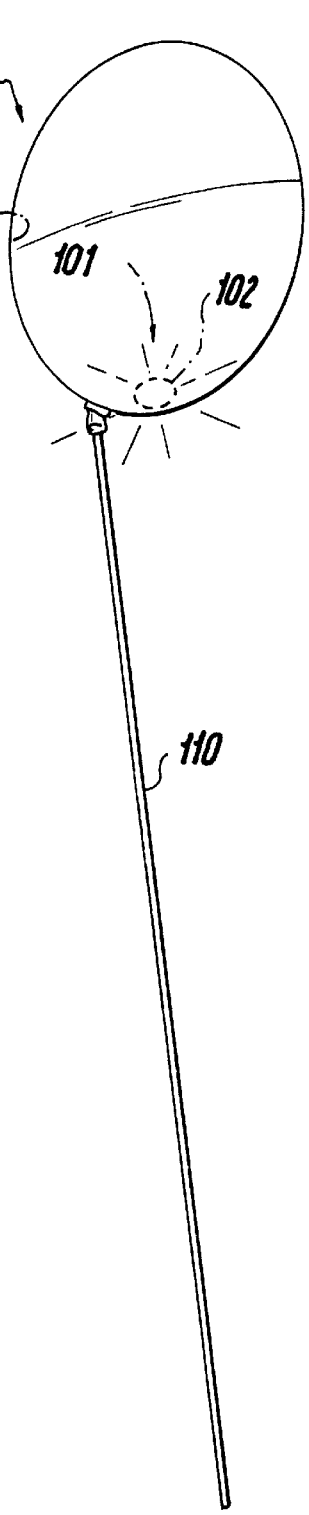
FIG. 15 is a side elevated view of a single embodiment for an illuminated insert within a non-buoyant balloon.

As shown in FIG. 15, insert 101 or 101*a* can be made of a weight greater than 14 grams (1 ounce), but then it can only be inserted within a non-buoyant, air filled balloon which is supported upon a semi-rigid member 110, such as a wooden or plastic pole, or is hung inverted from a ceiling mounted cable, (not shown) such as a string.

It is known that other modifications may be made to the present invention without departing from the scope of the invention, as noted in the appended claims.

What is claimed is:

1. An illuminated balloon assembly comprising:

an inflatable translucent balloon, said inflatable translucent balloon having therein:

a freely movable insert member insertable within said balloon, said freely movable insert member having a light source therein, said insert member responding to kinetic movement of said inflatable translucent balloon, wherein said insert has a weight less than a net lifting weight of said balloon, upon inflation of said balloon.

2. The illuminated balloon assembly as in claim 1 wherein said freely movable insert is a three dimensional body having a curved surface on at least a portion thereabout, wherein said insert rolls freely about its exterior surface within a corresponding concave interior of said balloon.

3. The illuminated balloon assembly as in claim 1 wherein said insert is a translucent sac filled with chemiluminescent material.

4. The illuminated balloon assembly as in claim 1 wherein said insert is a translucent sac with a miniature battery, said battery powering said light source.

5. The illuminated balloon assembly as in claim 1 wherein said insert member is faceted on its exterior surface.

6. An illuminated balloon assembly comprising:

an inflatable translucent balloon, said inflatable translucent balloon having therein:

a freely movable insert member insertable within said balloon, said freely movable insert member having a light source therein, said insert member responding to kinetic movement of said inflatable translucent balloon, wherein said insert member is egg shaped.

7. The illuminated balloon assembly as in claim 6 wherein said freely movable insert is a three dimensional body having a curved surface on at least a portion thereabout, wherein said insert rolls freely about its exterior surface within a corresponding concave interior of said balloon.

8. The illuminated balloon assembly as in claim 6 wherein said insert is a translucent sac filled with chemiluminescent material.

9. The illuminated balloon assembly as in claim 6 wherein said insert is a translucent sac with a miniature battery, said battery powering said light source.

10. The illuminated balloon assembly as in claim 6 wherein said insert member is faceted on its exterior surface.

* * * * *